US005676002A

United States Patent [19]

Hoeptner, III

[11] Patent Number: 5,676,002

[45] Date of Patent: Oct. 14, 1997

[54] VEHICLE LOCK GUARD

[75] Inventor: Herbert William Hoeptner, III, Morgan Hill, Calif.

[73] Assignee: James S. Chong, Kensington, Calif.

[21] Appl. No.: 419,119

[22] Filed: Apr. 10, 1995

[51] Int. Cl.[6] ..... E05B 17/20

[52] U.S. Cl. ..... 70/416; 70/448; 292/346; 292/DIG. 23

[58] Field of Search ..... 70/417, 416, 418, 70/423, 448, 451; 292/346, DIG. 23, DIG. 67

[56] References Cited

U.S. PATENT DOCUMENTS

| | | | |
|---|---|---|---|
| 3,084,965 | 4/1963 | Carosello | 292/1 |
| 3,414,306 | 12/1968 | Bernstein | 70/416 |
| 3,718,014 | 2/1973 | Delgadillo | 70/56 |
| 3,768,284 | 10/1973 | Kent et al. | 70/104 |
| 3,976,318 | 8/1976 | Krus | 292/346 |
| 4,041,741 | 8/1977 | Cintron | 70/417 |
| 4,052,094 | 10/1977 | Widen | 292/336.3 |
| 4,074,552 | 2/1978 | Smith | 70/417 |
| 4,113,294 | 9/1978 | Bierman | 292/346 |
| 4,132,092 | 1/1979 | Steinbach | 70/208 |
| 4,212,176 | 7/1980 | Hegedus | 70/417 |
| 4,397,168 | 8/1983 | Rotondi et al. | 70/417 |
| 4,401,247 | 8/1983 | Zoor | 224/315 |
| 4,508,379 | 4/1985 | Mochida | 292/336.43 |
| 4,619,123 | 10/1986 | Hill | 70/417 |
| 4,850,209 | 7/1989 | Weinerman et al. | 70/208 |
| 4,852,373 | 8/1989 | McGough | 70/417 |
| 5,176,016 | 1/1993 | Hill | 70/417 |
| 5,435,609 | 7/1995 | Igata et al. | 292/346 |

*Primary Examiner*—Steven N. Meyers
*Assistant Examiner*—Donald J. Lecher
*Attorney, Agent, or Firm*—Harris Zimmerman

[57] ABSTRACT

Unlocking of a vehicle door by insertion of implements other than the door key into the door is prevented by a guard housing within the door into which the key turnable inner end of the lock cylinder extends and which also encloses an otherwise vulnerable portion of the linkage which interconnects the lock cylinder and the door latching means. In a preferred form of the invention, the housing has an extension which extends below the lock cylinder and which is angled to extend to the outer shell of the door and then downward along the inner surface of the shell and which extends between the shell and the side impact beam of the door. The guard may secured in place by the same bolt that secures the handle assembly to the door and is wholly within and concealed by the door.

15 Claims, 3 Drawing Sheets

Fig. 6
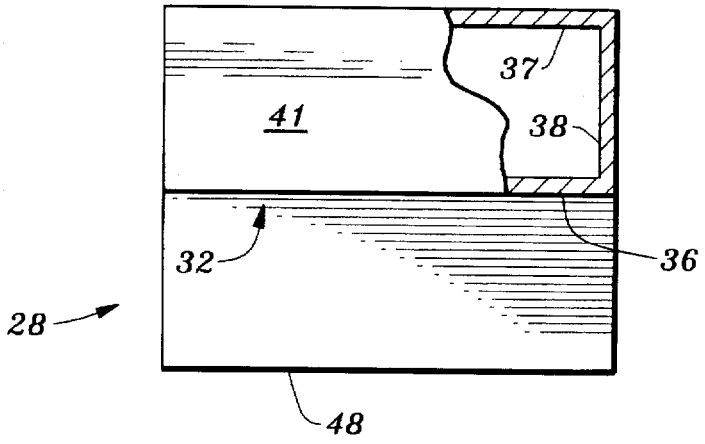
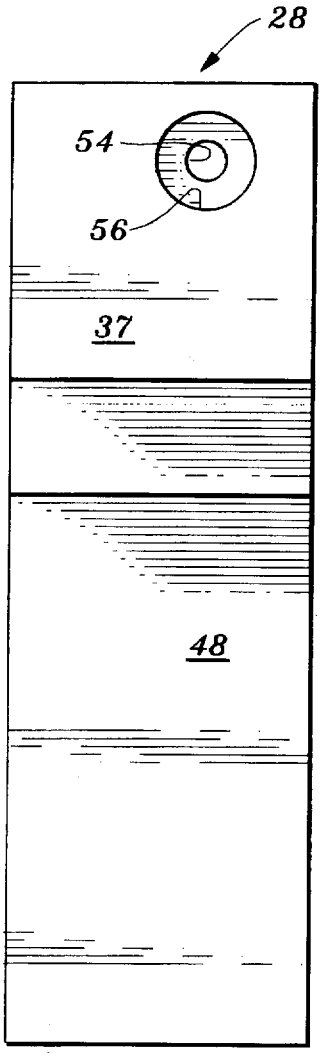
Fig. 5
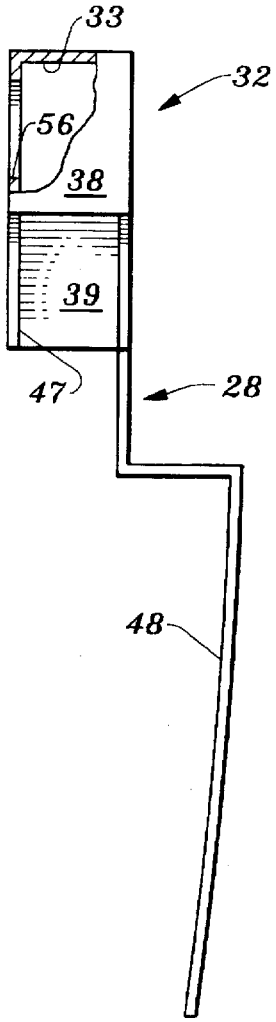
Fig. 4
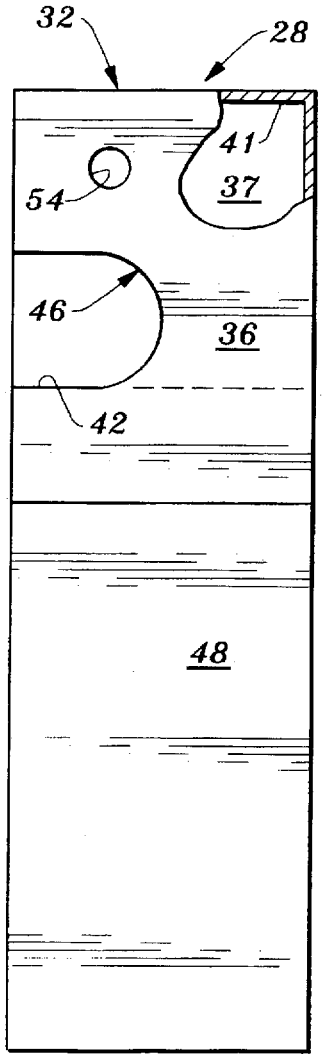
Fig. 3

VEHICLE LOCK GUARD

TECHNICAL FIELD

This invention relates to apparatus for preventing unauthorized entry into locked vehicles and more particularly to devices for preventing unlocking of a vehicle door by insertion of implements other than the door key into the door.

BACKGROUND OF THE INVENTION

The key operated lock of an automobile door includes a lock cylinder that extends into the door and which has a key turnable inner end and linkage which couples the inner end to the door latching mechanism. The lock cylinder is usually located a short distance below the door window. This makes the lock vulnerable to manipulation by car thieves or vandals.

Unauthorized unlocking of vehicle doors is often effected by inserting a thin tool, into the interior of the door through the slot opening that enables upward and downward travel of the door window. The tool typically has a hook like notch at its lower end which may be used to manipulate the linkage at the inner end of the lock cylinder and thereby unlock the door. A skilled thief can accomplish the same result using other devices such as a hooked length of stiff coat hanger wire for example. The prior art does not provide any effective device for preventing unlocking of a vehicle door by this technique.

The lock cylinder is often a component of a door handle assembly that seats at a conforming opening in the outer shell of the door. Another common technique for unlocking the door is effected by inserting a screw driver or similar tool between the edges of the handle assembly and the opening in order to manipulate the lock cylinder linkage. The tool deforms the material of the door during the course of this operation. One prior device for inhibiting this form of lock manipulation requires overlaying of the edge of the door handle assembly and the adjacent outer surface of the door with a thick metal shield that cannot be deformed with a screw driver or like tool. While this is effective for the purpose it also alters the appearance of the vehicle in a manner that may not be desirable to the owner.

Some prior protective devices for other types of lock, such as an automobile trunk lock for example, are secured to the vehicle with bolts or the like which require drilling of holes in the exterior surface of the vehicle. Again, many owners would prefer not to alter their vehicle in this manner. A lock protector that does not require such alteration of other components of the vehicle would be preferable to many owners.

The present invention is directed to overcoming one or more of the problems discussed above.

SUMMARY OF THE INVENTION

In one aspect the present invention provides a guard device for preventing unlocking of a vehicle door by insertion of implements other than the door key into the door. Doors of the type to which the guard device is applicable have latching means with a locking member thereat which is shiftable to lock the door and have a key operated lock cylinder with an outer end that is accessible from outside of the vehicle and a key turnable inner end that is situated within the door. The inner end of the lock cylinder is coupled to the latching means locking member by linkage in order to lock and unlock the door in response to turning of the inner end of the cylinder with the door key. The guard device has a housing proportioned for disposition within the door at the location of the inner end of the lock cylinder. The housing has an interior chamber shaped to receive the key turnable inner end of the lock cylinder and also the end of the linkage that is coupled to the cylinder. The housing has first and second openings which respectively enable entry of the inner end of the lock cylinder and entry of the end of the linkage into the chamber.

In another aspect of the invention, an extension of a first side wall of the housing extends below the interior chamber of the housing and is angled to extend into contact with the outer shell of the door and then downward for a distance along the inner surface of the outer shell.

In another aspect of the invention, a vehicle door includes latching means having a locking member which is shiftable to lock the door and a lock cylinder disposed at an opening in the outer shell of the door. The cylinder has an outer end that is accessible from the outside of the vehicle and an inner end which is within the door and which is turnable by use of the door key. A pivoting arm extends radially from the inner end of the lock cylinder within the door and a link couples the pivoting arm to the locking member of the latching means. A guard device prevents unlocking of the door by insertion of implements other than the door key into the door. The guard device has a housing with first and second spaced apart side walls and a top wall and first and second end walls forming a chamber proportioned to contain the inner end of the lock cylinder and the pivoting arm. The first side wall has a first opening through which the lock cylinder extends into the housing which first opening extends to an edge of the first side wall. The first end wall extends downward from the top wall along the portion of the first side wall edge which is above the first opening. The housing has a second opening at the underside thereof through which the link extends into the housing. The guard device is wholly contained within the door and is concealed by the door.

In another aspect of the invention, the first side wall of the housing extends below the housing chamber and is angled to extend into contact with the outer shell of the door and then downward for a distance along the inner surface of the outer shell. The extension passes between the outer shell and the side impact beam of the door and is thereby clamped at a fixed orientation.

The invention contains and shields the inner end of the key operated lock cylinder of a vehicle door and also the adjacent portion of the linkage that interconnects the cylinder and the door latching means when such linkage is at its locking position. Consequently, these otherwise vulnerable components of the lock system cannot be manipulated with a slim tool that is inserted into the slot like opening at the base of the door window. In a preferred form of the invention, the lock guard has an extension which extends below the location of the lock cylinder and preferably outward to the outer shell of the door and then downward along the inner surface of the shell for a distance. This defeats efforts to unlock the door by entry of a screw driver or like between the door handle assembly and the opening in which it is seated. The lock guard can easily be retrofitted into pre-existing vehicle doors and in the preferred form the guard is secured in place by a fastener which is already present for the purpose of securing the door handle assembly in place and by disposition of the downward extension of the guard between the outer shell and side impact beam of the door.

The invention, together with further aspects and advantages thereof, may be further understood by reference to the following description of a preferred embodiment and by reference to the accompanying drawings.

BRIEF DESCRIPTION OF THE DRAWINGS

FIG. 3 is an elevation view of a first side of a vehicle lock guard in accordance with a preferred embodiment of the invention, a portion of the side wall of the guard being broken out.

FIG. 4 is a broken out end view of the lock guard of FIG. 3.

FIG. 5 is an elevation view of the opposite side of the vehicle lock guard of FIG. 3.

FIG. 6 is a broken out top view of the vehicle lock guard.

DETAILED DESCRIPTION OF THE PREFERRED EMBODIMENT

Figure 1:
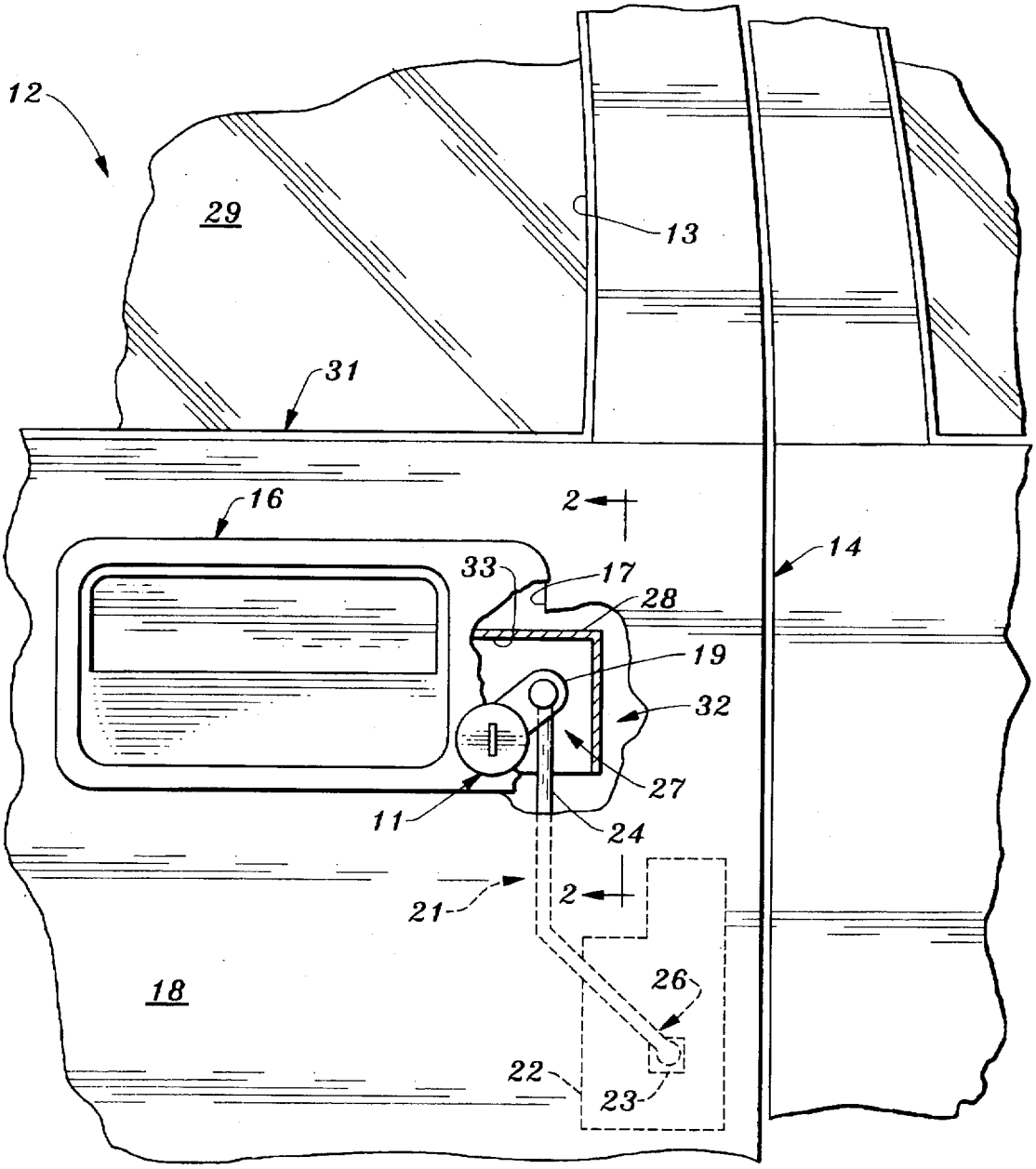
FIG. 1 is an elevation view of the region of a side of an automobile at which a door handle assembly is located, portions of the door being broken out to expose interior components.
Figure 2:
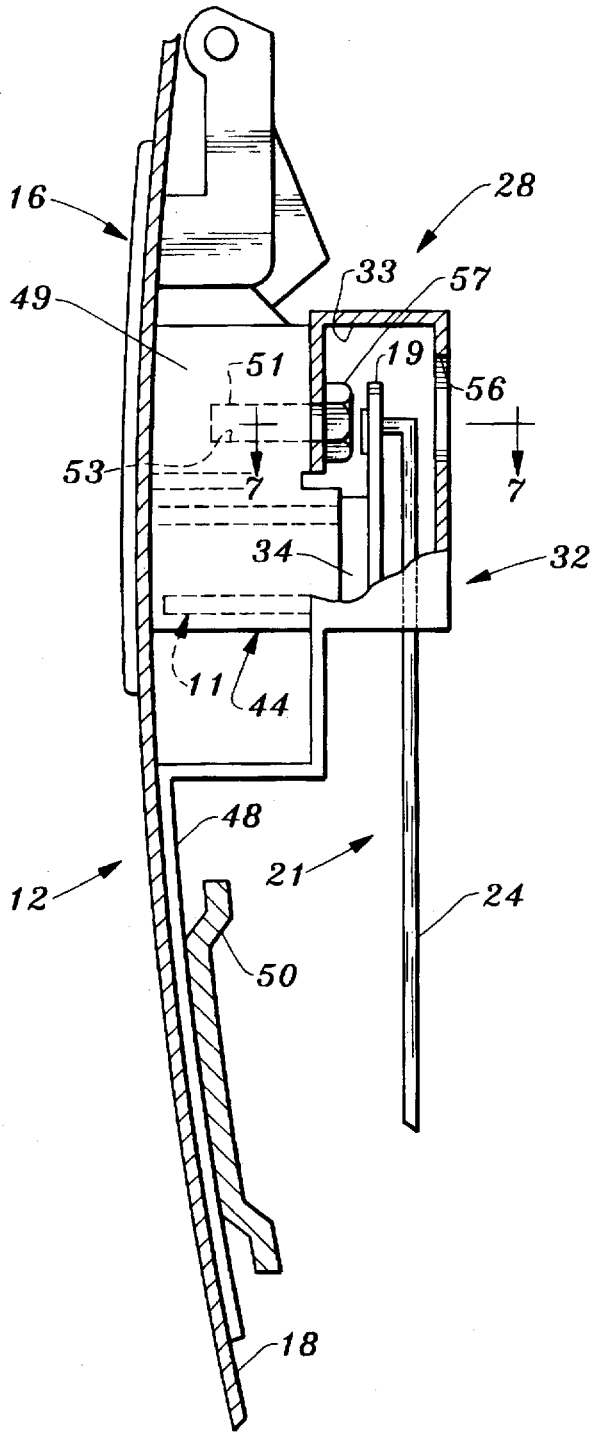
FIG. 2 is an elevation section view taken along line 2—2 of FIG. 1.

Referring jointly to FIGS. 1 and 2 of the drawings, the key operated lock cylinder 11 of an automobile door 12 is usually located below the window 13 of the door and at a location close to the back edge 14 of the door. In many cases as in this example the lock cylinder 11 is a component of a door handle assembly 16 which seats at a conforming opening 17 in the outer shell 18 of the door 12. Turning of the lock cylinder 11 with the door key pivots an arm 19 which extends radially from the inner end of the cylinder and which is a component of linkage 21 that interconnects the cylinder with the latching means 22 of the door. The latching means 22 has a locking member 23 which prevents unlatching of the door 12 when the member is held at a first position and which enables unlatching when is shifted to a second position. In the present example, linkage 21 includes a link 24 having an end 26 which is pivotably coupled to the locking member 23 of the latching means 22 and an opposite end 27 pivotably coupled to the pivoting arm 19 at lock cylinder 11. Thus turning of cylinder 11 with the door key shifts the member 23 between its locking and unlocking positions.

Lock cylinder 11, door handle assembly 16 and the door latching means 22 may each be of known conventional construction and thus will not be further described except as may be necessary to understand the interaction of the vehicle lock guard 28 therewith.

In the particular vehicle for which this example of the invention was designed, the door 12 is locked when the pivoting arm 19 is in the upwardly directed position that is shown in the drawings. Pivoting of the arm 19 to a downwardly directed orientation unlocks the door 12. In the absence of the present invention a thief can unlock the door 12 by inserting a thin tool into the door between the window pane 29 and the resilient bead 31 at the base of the window 13. The base of the tool can then be used to push arm 19 or the upper end of link 21 downward and thereby unlock the door 12. Alternately, a screw driver or similar tool can be forced between the edge of door handle assembly 16 and the adjacent outer shell 18 metal to accomplish the same result. The lock guard 28 defeats such activities.

The upper portion of guard 28 is a housing 32 having an interior chamber 33 shaped to contain the inner end 34 of lock cylinder 11, arm 19 and the upper end of link 21 when the arm is at its upwardly directed door locking orientation.

More particularly, with reference jointly to FIGS. 3 to 6, the housing portion 32 of the guard 28 has first and second spaced apart side walls 36 and 37 respectively, first and second end walls 38 and 39 respectively and a top wall 41 which jointly form a chamber 33 of rectangular configuration in this example. The housing 32 is proportioned to enable the previously described pivoting movement of arm 19. To facilitate installation of the guard 28, the first end wall 38 extends down from top wall 41 for a lesser distance than the side walls 36 and 37 and second end wall 39. A first opening 42 extends into first side wall 36 at the edge of the side wall that is below the short first end wall 38. Opening 42 in this example of the invention is a horizontal slot proportioned to receive the cylindrical sleeve portion 44 of door handle assembly 16, shown in FIG. 2, in which the lock cylinder 11 is seated. Referring jointly to FIGS. 2 and 3, slot 42 has a semicircular end 46 which conforms with the shape of the sleeve portion 44. Thus the guard 28 can be fitted into place by turning arm 19 to its downwardly directed position and then moving the guard in the direction of the front of the vehicle to seat sleeve 44 against the semicircular end 46 of slot 42. The sleeve 44 then prevents entry of a slim tool, screw driver or the like into chamber 33 at the otherwise open region of the housing below the shorter end wall 38 of the housing.

The open underside of the housing 32 provides a second opening 47 which allows link 21 to extend out of the housing and enables pivoting of arm 19 into its downwardly directed position.

The lower portion of the guard 28 in its preferred form is a downwardly directed extension 48 of the front side wall 36 of the housing 32. Extension 48 is angled to extend into contact with the outer shell 18 of the door and then extends downward for a distance along the inner surface of the shell. The portion of extension 48 that is in contact with shell 18 preferably has a curvature conforming with the curvature of the adjacent region of the shell. The extension 48 is of sufficient length to extend between the outer shell 18 and the side impact beam 50 which extends horizontally along the inner surface of the shell for reinforcement purposes in modern automobiles. This clamps the lower end of the guard 28 against the shell 18.

The downward extension 48 protects arm 19 and the upper end 27 of link 21 from manipulation by a screw driver or the like that may be inserted through door opening 17 at the base of the door assembly 16.

Figure 7:
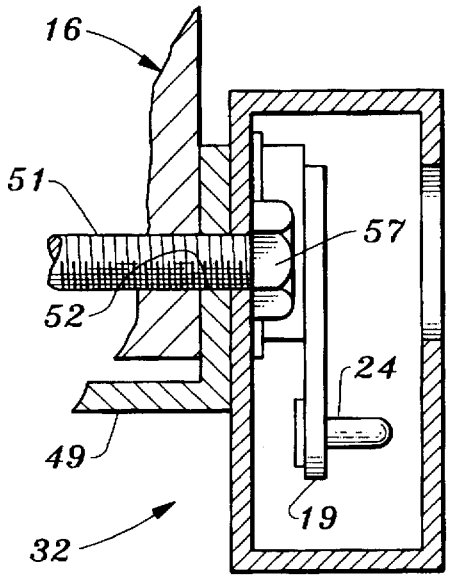
FIG. 7 is a section view of a portion of the apparatus of FIG. 2 taken along line 2—2 thereof.

Referring to FIGS. 2 and 7, the door handle assembly 16 seats against a pair of right angled brackets 49 which extend inward from the outer shell 18 at opposite ends of the assembly and the assembly is secured in place by a pair of bolts 51 which extend through openings 52 in the brackets and engage in threaded passages 53 in the assembly, only one of the brackets and one of the bolts being visible in the drawings. In this embodiment of the invention, the pre-existing bolt 51 which is closest to the lock cylinder 11 is used to secure guard 28 in place thereby eliminating any need for additional passages in the door components in order to accommodate to the guard. Referring jointly to FIGS. 2 to 5, the first and second side walls 36 and 37 of housing 32 are provided with aligned holes 54 and 56 respectively at the location of the bolt 51. The hole 54 in the first side wall 36 has a diameter similar to the diameter of the bolt 51. The hole 56 in second side wall 37 is larger and of sufficient size to enable entry of the bolt head 57 into chamber 33 as the bolt is being engaged with the door handle assembly 16. The bolt head 57 clamps first side wall 36 against bracket 49. Rotational displacement of the guard 28 about bolt 51 is inhibited by the previously described disposition of extension 48 between outer shell 18 and side impact beam 50.

The guard 28 which is shown in the drawings is designed for installation in the vehicle door which is to the left of the driver. A guard for the opposite door is essentially similar but has a mirror image configuration.

The vehicle lock guard 28 which has been herein described for purposes of example was designed for use in a specific type of vehicle which is an automobile of the type that is manufactured by the Honda Motor Company and marketed under the trademark ACURA. The configuration and proportions of the guard can readily be modified, where necessary, to accommodate to the differing interior door mechanisms of other brands of automobile. Also for purposes of example the invention has been described with reference to use in an automobile. The guard can be equally advantageous in other types of vehicle that have doors equipped with key operated locks.

Thus while the invention has been described with respect to a single embodiment for purposes of example, many modifications and variations are possible and it is not intended to limit the invention except as defined by the following claims.

I claim:

1. A guard device for preventing unlocking of a vehicle door by insertion of implements other than a door key into the door, said guard device having a housing adapted for disposition within said door at the location of a key turnable inner end of a lock cylinder of the door, said housing having an interior chamber adapted to receive said key turnable inner end of said lock cylinder and an end of a link that is coupled thereto, said housing having first and second openings which respectively enable entry of said key turnable inner end of said lock cylinder and entry of said end of said link into said chamber, wherein said housing has spaced apart first and second opposite side walls and a top wall and spaced apart first and second end walls bounding said interior chamber, wherein first side wall including an edge thereof that is adjacent said first end wall extends down from said top wall for a distance that exceeds the length of said first end wall, said first opening for enabling entry of said inner end of said lock cylinder being a horizontal slot which extends into said first side wall from said edge thereof at a location which is below said first end wall.

2. The guard device of claim 1 wherein said second end wall and said second side wall extend downward from said top wall for a distance that is greater than the length of said first end wall.

3. The guard device of claim 1 wherein said second opening which enables entry of a link into said chamber is at the underside of said housing.

4. The guard device of claim 1 wherein said housing has a fully open underside which forms said second opening for enabling entry of a link into said chamber.

5. The guard device of claim 1 wherein said first and second side walls have aligned holes therein for enabling a bolt to be entered into said housing in order to secure said device to said door.

6. The guard device of claim 5 wherein the hole in said second side wall is larger than the hole in said first side wall.

7. The guard device of claim 1 wherein said first side wall of said housing has a lower portion which extends below said interior chamber of said housing.

8. The guard device of claim 7 wherein said lower portion of said first side wall is angled to extend into contact with an outer shell of a vehicle door.

9. The guard device of claim 8 wherein said lower portion of said first side wall is further angled to extend downward along an outer shell of a vehicle door in contact therewith.

10. The guard device of claim 9 wherein the region of said lower portion of said first side wall that is angled to extend downward along an outer shell of a vehicle door has a curvature conforming to the curvature of a vehicle door shell.

11. The guard device of claim 9 wherein said lower portion of said first side wall is of sufficient length to extend between an outer shell and a side impact beam of a vehicle door.

12. In a vehicle door which includes latching means having a locking member which is shiftable to lock the door, a lock cylinder disposed at an opening in an outer shell of the door and having an outer end that is accessible from the outside of said vehicle and an inner end which is within the door and which is turnable by use of a door key, a pivoting arm extending radially from said inner end of said lock cylinder within said door and a link coupling said pivoting arm to said locking member of said latching means, the improvement comprising:

a guard device for preventing unlocking of the door by insertion of implements other than the door key into the door, said guard device having a housing with first and second spaced apart side walls and a top wall and first and second end walls forming a chamber proportioned to contain said inner end of said lock cylinder and said pivoting arm, said first side wall having a first opening through which said lock cylinder extends into said housing which first opening extends to an edge of said first side wall and wherein said first end wall extends downward from said top wall along the portion of said edge which is above said first opening, said housing having a second opening at the underside thereof through which said link extends into said housing, said guard device being wholly contained within and concealed by said door.

13. The apparatus of claim 12 wherein said first side wall of said housing has an extension which extends below said lock cylinder and which is angled to extend to said outer shell of said door and then downward for a distance along said outer shell of said door.

14. The apparatus of claim 12 wherein said lock cylinder is a component of a handle assembly which is disposed at a conforming opening in said outer shell of said door and which is secured thereto by a threaded fastener which engages in a threaded opening in said handle assembly, wherein said fastener extends through said housing to clamp said guard device against said handle assembly.

15. The apparatus of claim 12 wherein said vehicle door has an outer shell and a side impact beam which extends along said shell at a location below said lock cylinder and wherein said guard device has an extension of said first side wall that extends down between said outer shell and said side impact beam.

* * * * *